United States Patent [19]

Weidner et al.

[11] 4,316,413

[45] Feb. 23, 1982

[54] GENERATOR FOR A SPIN-PROJECTILE

[75] Inventors: Peter Weidner, Breitenbrunn; Dietmar Stützle, Lauf/Pegnitz, both of Fed. Rep. of Germany

[73] Assignee: Diehl GmbH & Co., Nuremberg, Fed. Rep. of Germany

[21] Appl. No.: 118,092

[22] Filed: Feb. 4, 1980

[30] Foreign Application Priority Data

Feb. 7, 1979 [DE] Fed. Rep. of Germany ..... 2904501

[51] Int. Cl.[3] ..... F42C 11/02

[52] U.S. Cl. ..... 102/210

[58] Field of Search ..... 102/210; 310/339, 367, 310/369

[56] References Cited

U.S. PATENT DOCUMENTS

| | | | |
|---|---|---|---|
| 3,239,678 | 3/1966 | Kolm et al. | 102/210 |
| 3,470,818 | 10/1969 | Harnau | 102/210 |
| 3,539,841 | 11/1970 | Riff | 310/369 |

*Primary Examiner*—Charles T. Jordan

*Attorney, Agent, or Firm*—Scully, Scott, Murphy & Presser

[57] ABSTRACT

Generator for generating electrical ignition or detonation energy in a spin projectile through a piezo element utilizing the spin of the projectile for generating the electrical energy. The piezo element lies against the interior of the projectile shell and is polarized radially relative to the longitudinal axis of the projectile. Preferably, the piezo element is of tubular configuration. A core is radially movably supported interiorly of the projectile shell so as to charge the piezo element during the rotational acceleration of the projectile.

5 Claims, 1 Drawing Figure

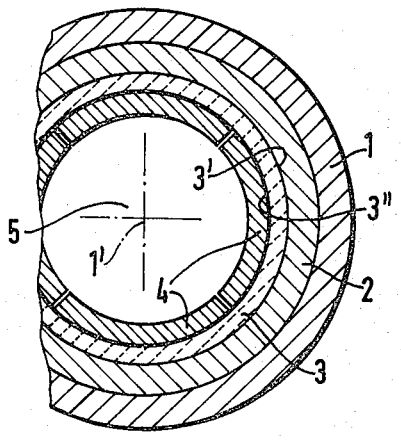
1
3'
3"
5
1'
4
2
3

GENERATOR FOR A SPIN-PROJECTILE

BACKGROUND OF THE INVENTION

1. Field of the Invention

The present invention relates to a generator for the generation of the electrical ignition or detonation energy in a spin projectile through the intermediary of a piezo element arranged within the projectile.

2. Discussion of the Prior Art

Heretofore, in generators of this type, acceleration acting in the axial direction of the projectile has been utilized for the charging of the piezo element. However, the surface area of the piezo element is restricted by the caliber of the projectile.

It is also known that the rotational acceleration of a spin projectile can be utilized for the setting of a mechanical arming arrangement.

SUMMARY OF THE INVENTION

Accordingly, it is an object of the present invention to propose a generator of the above-mentioned type in which the radial acceleration which occurs during the rotation of a spin projectile is employed for the generation of a charge in a piezo element.

The foregoing object is inventively attained in that the piezo element is arranged so as to either directly or indirectly contact the interior of the shell of the projectile and is polarized radially relative to the longitudinal axis of the projectile; and wherein a core is supported in a radially movable manner within the projectile shell so as to charge the piezo element during the rotational acceleration of the projectile.

Achieved through the present invention is the novel concept that the rotational movement can be employed for the generation of the charge. Moreover, the generated charge, possibly in conjunction with the evaluation of a translational acceleration, can also be utilized as an arming criterion. The charge is then only available upon rotation of the projectile.

It is advantageous in the present invention that the surface area of the piezo element which is essential for the generation of the charge is not restricted by the caliber of the projectile. The height of the projectile element which extends in the direction of the longitudinal axis can, without difficulty, be designed to such an extent that, with consideration being given to the pressure which is applied against the piezo element by the core, there will be generated the necessary ignition or detonation energy. In addition thereto, the space within the core is available for the positioning of an ignition or detonating arrangement.

Additionally, the core can be supported so as to be axially displaceable. The core can then be utilized as a component of an arming arrangement.

BRIEF DESCRIPTION OF THE DRAWING

Further advantageous embodiments of the invention can now be ascertained from the following detailed description, taken in conjunction with the single FIGURE of the accompanying drawing, in a fragmentary cross-section through the projectile.

DETAILED DESCRIPTION

Referring now to the drawing, a projectile includes a projectile shell 1. Positioned against the inner circumference of the projectile shell 1 is a metal sleeve 2 onto which there is shrink-fitted a piezo element 3.

The piezo element 3 is tubularly spaced. Piezo element 3 is metallized along its external circumference 3' and its interior circumference 3'', and wherein these metal coatings are connected to a known per se ignition or detonation circuit. Moreover, the piezo element 3 is polarized radially relative to the axis 1' of the projectile. A core 4 is supported within the piezo element 3, and is constituted of a plurality of radially segmented core components. A cylindrical space 5 remains within the core 4, in which, for example, there can be positioned the ignition or detonation arrangement of the projectile.

The manner of operation of the above-described generator is generally as follows:

As soon as the projectile has a spinning motion imparted thereto by the riflings (not shown) of a weapon barrel, a centripetal acceleration will act on the core 4 or the core segments. As a result of inertia, the core is pressed against the piezo element 3 so that a voltage will occur at the coatings 3', 3'' thereof, and which is then utilized for the charging of an ignition or detonation circuit.

The metal sleeve 2 serves for the support of the piezo element 3 within the projectile shell 1 which is as free as possible from any play. Thus, any shifting of the piezo element 3 under pressure of the core 4 is thusly avoided. The metal sleeve 2 can also be replaced by a casting compound.

The height of the core 4 (perpendicular to the plane of the drawing of the single FIGURE) is approximately equal to that of the piezo element 3. The last-mentioned element can be selected pursuant to current requirements.

Within the scope of the invention it is also possible to contemplate numerous other embodiments.

We claim:

1. In a generator for the generation of electrical energy including a spin projectile and a piezo element in said spin projectile; the improvement comprising: said piezo element having a tubular configuration and contacting the interior of the projectile shell, and further being polarized radially relative to the longitudinal axis of said projectile; and core means being radially segmented and also being radially movably supported within said projectile shell so as to charge said piezo element during the rotational acceleration of said projectile.

2. Generator as claimed in claim 1, said piezo element being in direct contact with said projectile shell.

3. Generator as claimed in claim 1, said piezo element being in indirect contact with said projectile shell.

4. Generator as claimed in claim 1, said piezo element being embedded free from play into said projectile shell.

5. Generator as claimed in claim 1, said core means being shaped so as to form a space interiorly of said projectile shell.

* * * * *